US008205687B2

(12) United States Patent
Radford

(10) Patent No.: US 8,205,687 B2
(45) Date of Patent: Jun. 26, 2012

(54) COMPOUND ENGAGEMENT PROFILE ON A BLADE OF A DOWN-HOLE STABILIZER AND METHODS THEREFOR

(75) Inventor: Steven R. Radford, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 95 days.

(21) Appl. No.: 12/416,386

(22) Filed: Apr. 1, 2009

(65) Prior Publication Data

US 2009/0242277 A1 Oct. 1, 2009

Related U.S. Application Data

(60) Provisional application No. 61/041,421, filed on Apr. 1, 2008.

(51) Int. Cl.
*E21B 17/10* (2006.01)

(52) U.S. Cl. ..... 175/57; 175/325.1; 175/325.4

(58) Field of Classification Search ..... 175/57, 175/325.1, 325.2, 325.3, 325.4; 166/241.6
See application file for complete search history.

(56) References Cited

U.S. PATENT DOCUMENTS

| | | | | |
|---|---|---|---|---|
| 2,069,482 | A | 2/1937 | Seay | |
| 2,602,512 | A * | 7/1952 | Baker | 166/241.6 |
| 3,063,759 | A * | 11/1962 | Moore et al. | 175/325.2 |
| 3,105,562 | A | 10/1963 | Stone et al. | |
| 3,126,065 | A | 3/1964 | Chadderdon | |
| 3,211,232 | A | 10/1965 | Grimmer | |
| 3,289,768 | A * | 12/1966 | Solum | 166/241.6 |
| 3,642,079 | A * | 2/1972 | Van Note | 175/325.2 |
| 3,643,739 | A * | 2/1972 | Hall, Sr. | 166/241.6 |
| 4,458,761 | A | 7/1984 | Van Vreeswyk | |
| 4,842,083 | A | 6/1989 | Raney | |
| 4,889,197 | A | 12/1989 | Boe | |
| 5,139,098 | A | 8/1992 | Blake | |
| 5,293,945 | A | 3/1994 | Rosenhauch et al. | |
| 5,318,137 | A | 6/1994 | Johnson et al. | |
| 5,318,138 | A | 6/1994 | Dewey et al. | |
| 5,332,048 | A | 7/1994 | Underwood et al. | |
| 5,363,931 | A | 11/1994 | Moriarty | |
| 5,375,662 | A | 12/1994 | Echols, III et al. | |
| 5,853,054 | A | 12/1998 | McGarian et al. | |
| 6,131,675 | A | 10/2000 | Anderson | |
| 6,230,557 | B1 | 5/2001 | Ciglenec et al. | |
| 6,289,999 | B1 | 9/2001 | Dewey et al. | |
| 6,378,632 | B1 | 4/2002 | Dewey et al. | |
| 6,499,537 | B1 | 12/2002 | Dewey et al. | |

(Continued)

FOREIGN PATENT DOCUMENTS

EP 0594420 A1 4/1994

(Continued)

OTHER PUBLICATIONS

Merriam-Webster Online http://www.merriam-webster.com 2011 Merriam Webster, Incorporated.*

(Continued)

*Primary Examiner* — David Andrews
(74) *Attorney, Agent, or Firm* — TraskBritt

(57) ABSTRACT

A blade for a stabilizer configured with a compound engagement profile for reducing a tendency toward whirl and other vibrational effects when rotated within a borehole of a subterranean formation is provided. A method for stabilizing down-hole components is also provided.

12 Claims, 4 Drawing Sheets

U.S. PATENT DOCUMENTS

| | | | | |
|---|---|---|---|---|
| 6,732,817 | B2 | 5/2004 | Dewey et al. | |
| 7,048,078 | B2 | 5/2006 | Dewey et al. | |
| 7,159,668 | B2 * | 1/2007 | Herrera | 166/381 |
| 7,293,616 | B2 | 11/2007 | Tulloch | |
| 7,314,099 | B2 | 1/2008 | Dewey et al. | |
| 2007/0215388 | A1 | 9/2007 | Kirk et al. | |
| 2008/0105464 | A1 | 5/2008 | Radford | |
| 2008/0128175 | A1 | 6/2008 | Radford et al. | |
| 2008/0164019 | A1 * | 7/2008 | Angman | 166/241.6 |
| 2009/0242275 | A1 * | 10/2009 | Radford et al. | 175/57 |

FOREIGN PATENT DOCUMENTS

| | | | |
|---|---|---|---|
| JP | 02300494 | A | 12/1990 |
| JP | 06096933 | B2 | 11/1994 |
| JP | 07021678 | Y2 | 5/1995 |

OTHER PUBLICATIONS

PCT International Search Report for International Application No. PCT/US2009/039097, mailed Oct. 28, 2009.

U.S. Appl. No. 12/058,384, filed Mar. 28, 2008, entitled "Stabilizer and Reamer System Having Extensible Blades and Bearing Pads and Method of Using Same."

Radford, Steven, et al., "Novel Concentric Expandable Stabilizer Results in Increased Penetration Rates and Drilling Efficiency with Reduced Vibration," SPE/IADC 119534, prepared for presentation at the SPE/IADC Drilling Conference and Exhibition held in Amsterdam, The Netherlands, Mar. 17-19, 2009, 13 pages.

* cited by examiner

COMPOUND ENGAGEMENT PROFILE ON A BLADE OF A DOWN-HOLE STABILIZER AND METHODS THEREFOR

CROSS-REFERENCE TO RELATED APPLICATION

This application is a utility conversion of U.S. Provisional Patent Application Ser. No. 61/041,421, filed Apr. 1, 2008, for "Compound Engagement Profile on a Blade of a Downhole Stabilizer and Methods Therefor."

TECHNICAL FIELD

Embodiments of the present invention relate generally to blades on stabilizers used for stabilizing a drill string when drilling, reaming or otherwise conditioning, or exploring a subterranean borehole and, more particularly, to a compound engagement profile on a stabilizer blade for engaging a subterranean borehole wall, and including methods therefor.

BACKGROUND

Fixed and expandable stabilizers are typically employed in a drill string for stabilizing down-hole components such as drill bits, reamers, drill collars, and steering subs. Various approaches to drill a borehole, to ream a larger diameter borehole, to monitor the condition of a drilled borehole, or to condition a borehole may include the use of a stabilizer having stabilizer blades, blocks or pads used longitudinally above or below down-hole components of the bottom-hole assembly to increase stability and reduce dysfunctional loads, i.e., lateral vibrational loading, thereupon while engaging the borehole. For example, the use of stabilizers to improve the drilling performance of an expandable reamer is generally known to a person of ordinary skill in the art. Expandable stabilizer blades, blocks or pads may also incorporate features of expandable reamers, such as the movable bearing pad structure disclosed in U.S. patent application Ser. No. 11/875,241, filed Oct. 19, 2007, now U.S. Pat. No. 7,721,823, issued May 25, 2010, which is assigned to the assignee of the present invention and the disclosure of which is incorporated herein in its entirety by this reference, such apparatus being operated to an expanded state by the flow of fluid, such as drilling mud, or pressure within the drill string. However, conventional stabilizers are configured with relatively aggressive, i.e., square edges or a single 45 degree chamfer that tends to cause the stabilizer to grab the inside of the borehole or may induce whirl.

Notwithstanding the various conventional approaches to stabilize down-hole equipment when rotating in a borehole, a need exists for improved apparatus, systems, and methods for doing so. For instance, conventional systems for stabilizing while reaming a borehole (especially while back-reaming a drilled borehole) may encounter subterranean formation changes within the formation of the drilled borehole (i.e., a tight spot of swelled shale or filter cake in the formation, or other obstructions), which may induce the aforementioned instabilities in the stabilizer. Accordingly, there is an ongoing desire to improve or extend performance of a stabilizer, including a method of use therefor.

BRIEF SUMMARY OF THE INVENTION

In order to reduce vibrational instabilities, including whirl and lateral vibration, a stabilizer blade having a compound engagement profile is provided.

In accordance with an embodiment of the invention, a stabilizer blade for a stabilizer is configured with a compound engagement profile for reducing whirl and other vibrational effects when the stabilizer is rotated within a borehole of a subterranean formation.

A method for stabilizing down-hole equipment is also provided.

Other advantages and features of the present invention will become apparent when viewed in light of the detailed description of the various embodiments of the invention when taken in conjunction with the attached drawings and appended claims.

DETAILED DESCRIPTION OF THE INVENTION

The illustrations presented herein are, in most instances, not actual views of any particular reamer tool, stabilizer tool, drill string, cutting element, or other feature of a stabilizer and reamer system of a drilling assembly, but are merely idealized schematic representations that are employed to describe the present invention. Additionally, elements common between figures may retain the same numerical designation. Moreover, the lateral and longitudinal dimensions shown in the figures are merely idealized representations, as the actual dimensions are expected to vary according to specific application requirements in the field.

Figure 1:
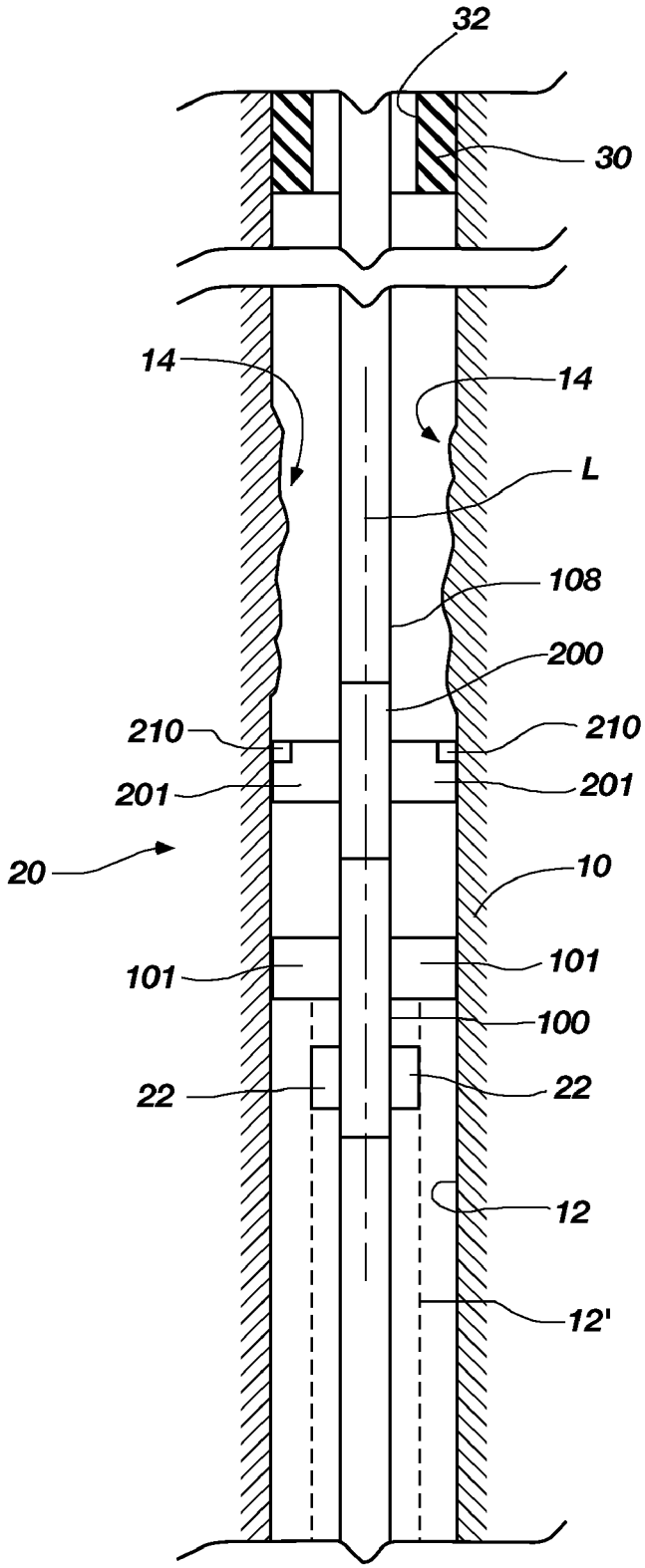
FIG. 1 is a longitudinal schematic view of a drilling assembly in accordance with an embodiment of the invention.

FIG. 1 is a longitudinal schematic view of a drilling assembly in accordance with an embodiment of the invention. A section of a drilling assembly generally designated by reference numeral 20 is shown reaming a borehole 12 extending through a formation 10 with an expandable reamer 100 followed by an expandable stabilizer 200. The expandable reamer 100 and the expandable stabilizer 200, respectively, include reamer blades 101 and bearing pads, or stabilizer blades 201 expanded to their full lateral extent for reaming and stabilizing the drilling assembly 20. The expandable stabilizer 200 may be adjacently located coaxially with the expandable reamer 100 in the drilling assembly 20 or separated by one or more drill pipe segments (not shown) in the drilling assembly 20. Optionally, the expandable reamer 100 and the expandable stabilizer 200 may comprise a single tool having a unitary body, of the drilling assembly 20. In any case, the expandable reamer 100 and the expandable stabilizer 200 are coupled together coaxially along a common central or longitudinal axis L of the drilling assembly 20. The expandable stabilizer 200 helps to control directional tendencies of the drilling assembly 20, reduce vibration, and stabilizes the expandable reamer 100 as the borehole 12 is reamed to a larger diameter beneath a smaller diameter borehole 32 of a casing or liner 30. Additionally, the expandable stabilizer 200 may be used to provide improved directional control, reduced vibration, and stabilize other equipment used for down-hole drilling, conditioning, or monitoring when rotationally engaging the wall of a borehole 12. Furthermore, while the expandable stabilizer 200 is presented in accordance with embodiments of the invention having compound engagement profiles in accordance with the invention (see reference numeral 330 e.g., compound engagement profile 330 of stabilizer blade 301, as show in FIG. 4) on select blades 201, a so-called "fixed" stabilizer may also be used, to advantage, with a blade having a compound engagement profile, as herein presented and described in further detail below.

This section of the drilling assembly 20 is shown as having reamed the diameter of borehole 12 in the "down-hole" direction with the reamer blades 101 carrying cutting elements (not shown) thereon while being fully extended, and now back-reaming in the "up-hole" direction while the stabilizer blades 201, configured with optional cutting structures 210 on their up-hole surfaces, remove, by trimming, formation material from the wall of the borehole 12 while still providing stabilization for the drilling assembly 20. In this respect, the drilling assembly 20 provides capability for reaming while stabilizing in either direction within borehole 12 without having to retract respective expandable blades 101 and 201 of the expandable reamer 100 and expandable stabilizer 200 in order to clear obstructions in the borehole 12, such as slump, swelled shale or filter cake, or other borehole obstructions and/or anomalies (e.g., those shown by reference numeral 14 in FIG. 1) existing or occurring after reaming portions of the borehole 12.

Advantageously, the drilling assembly 20 of the present invention allows reaming and stabilizing to be provided in either direction without having to deactivate the expandable reamer 100 and the expandable stabilizer 200 in order to retract the blades 101 and 102, respectively, in order to get past a section of formation 10 encroaching on (i.e., by formation slumping, formation swelling, or caking upon the borehole wall) the previously reamed or drilled borehole 12. The formation slump or swell, or caking in borehole 12 is indicated generally by reference numeral 14. The drilling assembly 20 enables reaming in the down-hole direction and then back-reaming in the up-hole direction without having to deactivate the expandable stabilizer 200 in order to bypass formation irregularities (shown by reference numeral 14) in the borehole 12. Another advantage afforded with the drilling assembly 20 is the ability to ream and then back-ream without retraction of the stabilizer blades 201 to get past any restrictions from irregularities and/or anomalies 14 in the borehole 12 of the formation 10, particularly when the expandable blades 101 and 201 of the expandable reamer 100 and the expandable stabilizer 200, respectively, are activated and deactivated by the same operational mechanism, such as hydraulic flow of drilling fluid through the flowbore (not shown) of the drilling assembly 20.

As also shown in FIG. 1, the drilling assembly 20 may also include fixed stabilizer blades or bearing pads 22 configured for allowing the drilling assembly 20 to pass through the smaller diameter borehole 32 of the casing or liner 30 and sized to provide stabilization behind a drill bit (not shown) as it drills a smaller borehole 12' (shown in broken lines) than the expanded borehole 12 through the formation 10. Moreover, the fixed stabilizer blades 22 provide stabilizing support for the expandable reamer 100 thereabove, due to its presence in the smaller borehole 12' being drilled, as the expandable reamer 100 enlarges the borehole diameter to that of borehole 12 when drilling in the down-hole direction through the smaller borehole 12', while the expandable stabilizer 200 provides stabilizing support for the expandable reamer 100 in the expanded borehole 12. Having generally described fixed and expandable stabilizers selectively configured for use with down-hole equipment used for drilling, conditioning, and/or monitoring a subterranean borehole, attention is now directed to specific details of at least one blade of a stabilizer, the at least one blade of the stabilizer comprising a compound engagement profile in accordance with embodiments of the invention.

Figure 4:
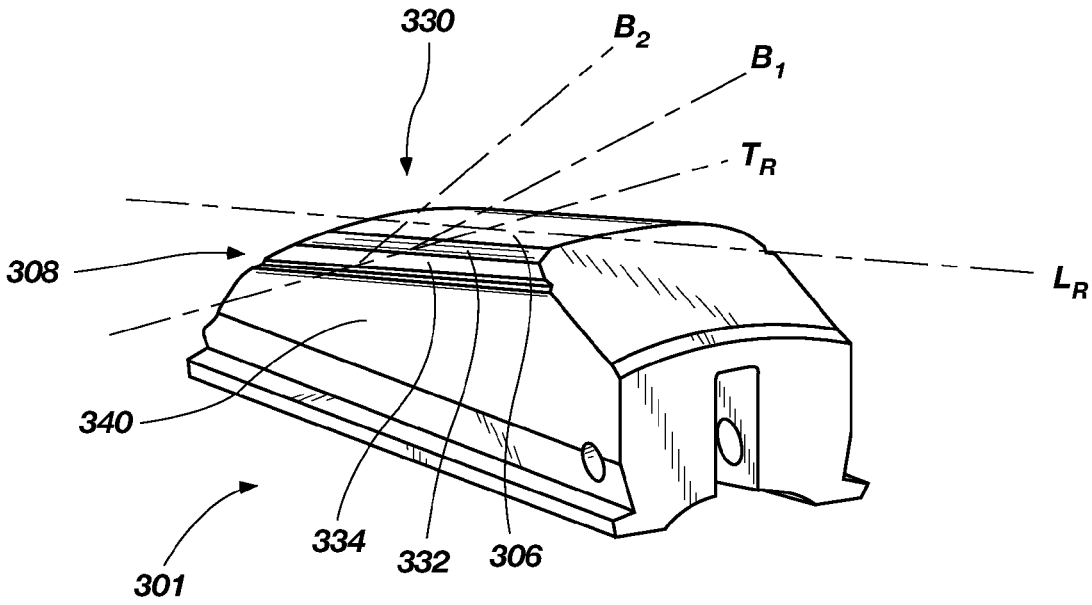
FIG. 4 is a longitudinal perspective view of a stabilizer blade suitable for use in accordance with an embodiment of the invention.
Figure 5:
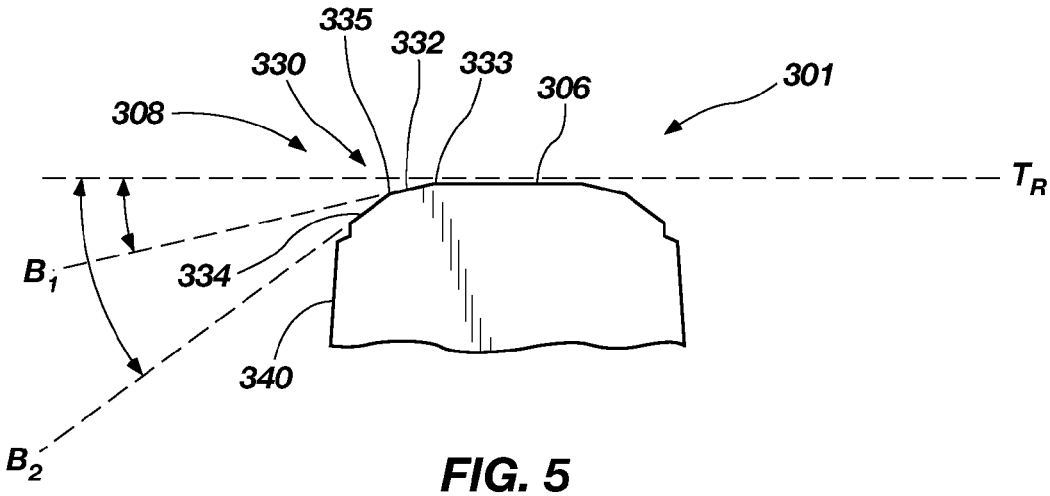
FIG. 5 is a partial, transverse cross-sectional view of the stabilizer blade shown in FIG. 4.

In an embodiment of the invention, an expandable stabilizer may include a stabilizer blade having a compound engagement profile on its rotational leading edge in order to improve rotational stability of a drilling assembly while drilling. As shown in FIG. 4, a stabilizer blade 301 includes a bearing surface 306 and a compound engagement profile 330 on a rotational leading edge 308. The stabilizer blade 301, as shown in this embodiment of the invention is for use with an expandable stabilizer. Reference may also be made to FIG. 5, showing a partial cross-sectional view of the stabilizer blade 301 of FIG. 4. The compound engagement profile 330 in this embodiment comprises a compound bevel, which includes a first bevel surface 332 and a second bevel surface 334. The first bevel surface 332 provides for a smooth, non-aggressive lead-in angle (the angle shown between tangential reference line $T_R$ of the bearing surface 306 and the bevel reference line $B_1$) relative to the bearing surface 306 of the stabilizer blade 301, while the second bevel surface 334 provides transition between the leading face 340 and the first bevel surface 332 of stabilizer blade 301, as the stabilizer blade 301 comes into contact with a formation. The second bevel surface 334 has a steeper lead-in angle (the angle shown between tangential reference line $T_R$ of the bearing surface 306 and the bevel reference line $B_2$) relative to the first bevel surface 332. The first and second bevel surfaces 332 and 334, respectively, extend longitudinally between the rotational leading edge 308 and the bearing surface 306 of the stabilizer blade 301 and include angles of about 15 degrees and 45 degrees, respectively, (i.e., the angle between bevel reference lines $B_1$ and tangential reference line $T_R$ is 15 degrees and the angle between bevel reference lines $B_1$ and $B_2$ is 30 degrees). However, other suitable included angles greater or lesser than the 15 degrees and 45 degrees described may be employed. Referring back to FIG. 4, the tangential reference line $T_R$ is perpendicular to the longitudinal axis as referenced by $L_R$ and is tangential to the bearing surface 306.

The bearing surface 306 is convex or arcuate in shape; having a radius of curvature substantially configured to conform to an inner radius of a borehole (i.e., the so-called "gage OD" of the stabilizer). Optionally, the bearing surface 306 may have be convexly shaped to a greater or lesser extent than shown, or may be substantially flat relative to the tangential reference line $T_R$.

The first bevel surface 332 is substantially linear while providing transition between the second bevel surface 334 and the bearing surface 306 for reducing vibrational engagement when contacting a wall of a borehole. Similarly, the second bevel surface 334 is substantially linear to provide transition between the leading face 340 and the first bevel surface 332 of the blade 301. Advantageously, the second bevel surface 334, the first bevel surface 332, or both, help to reduce the tendency of the drill string to whirl by progressively providing, as necessitated, transitional contact with the material of a subterranean formation delineating a wall of a borehole as a stabilizer is rotated therein. Optionally, either the first bevel surface 332, the second bevel surface 334, or both, may have a curvilinear shape, e.g., convex or arcuate. The transition between the second bevel surface 334, the first bevel surface 332 and the bearing surface 306 may be continuous or may include discrete transitions as illustrated by inflection points 335 and 333, respectively, between surfaces as shown in FIG. 5.

In accordance with an embodiment of the invention, in providing enhanced stabilization, a stabilizer may incorporate the compound engagement profile 330 upon one or more of the blades making up the stabilizer. Where the compound engagement profile 330 is included upon less than all the blades forming the stabilizer, the compound engagement profile 330 may be included upon the blades in a symmetric or asymmetric fashion.

It is further recognized that a greater number of bevel surfaces than the first and second bevel surfaces 332 and 334, respectively, may be provided, where each additional bevel surface includes a progressively steeper lead-in angle relative to any one of the preceding bevel surfaces between it and the bearing surface 306.

Figure 3A:
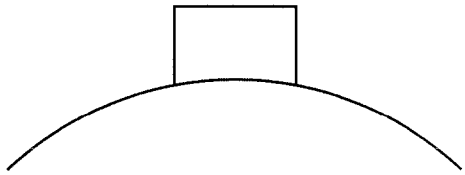
FIG. 3A (PRIOR ART)
FIGS. 3A and 3B each show partial, transverse cross-sectional views of conventional stabilizer blades.
Figure 3B:
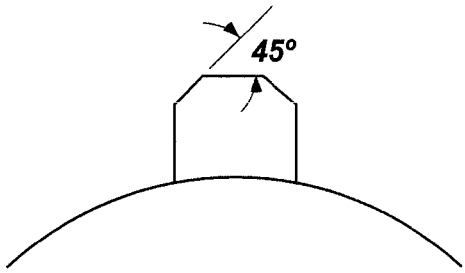
FIG. 3B (PRIOR ART)

By providing a compound engagement profile 330 upon the stabilizer blade 301, a pronounced improvement over conventional stabilizers is achieved, particularly when compared with expandable stabilizers having conventional profiles. The conventional stabilizers (shown in FIGS. 3A and 3B) include leading edges that are rectangular in profile, having a sharp corner or a pronounced bevel, such as a 45 degree bevel (see FIG. 3B), which is particularly aggressive when encountering irregularities in the borehole of the subterranean formation like swelled shale, as mentioned hereinabove. Increased stability, and reduced whirl and lateral vibration is achieved by providing the compound engagement profile 330 that provides rotational transition between the bearing surface 306 of the stabilizer blade 301 with the subterranean formation and further helps to reduce other undesirable effects such as bit whirl. By reducing the propensity of a stabilizer to the effects of whirl; lateral vibrations are also diminished.

Figure 2:
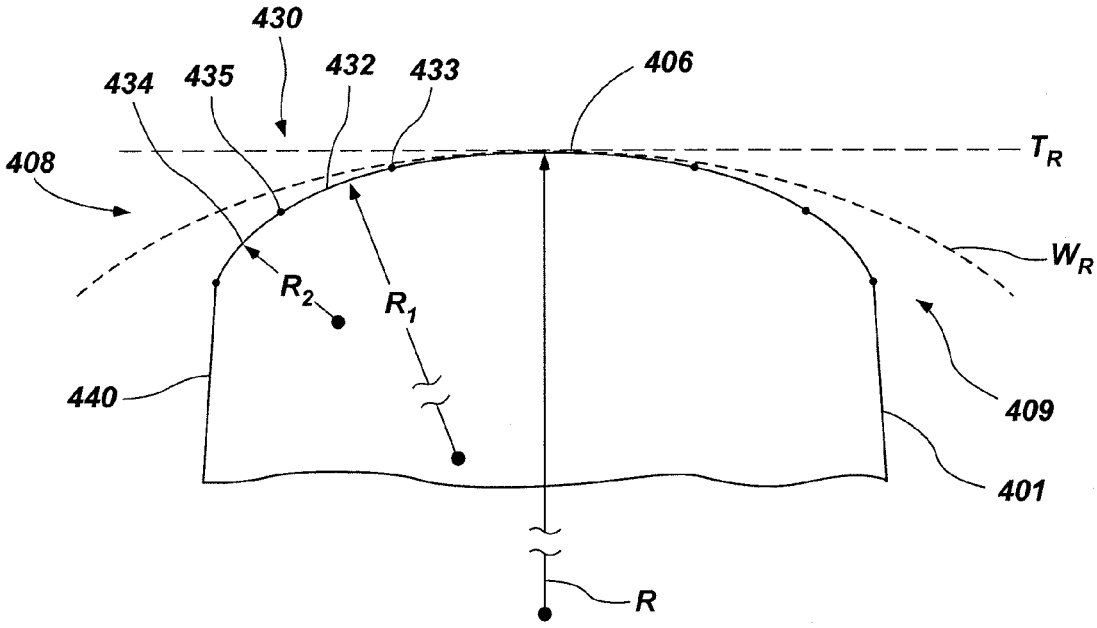
FIG. 2 is a partial, transverse cross-sectional view of a stabilizer blade in accordance with another embodiment of the invention.

In another embodiment of the invention as shown in FIG. 2, a stabilizer blade 401 of a stabilizer (not shown) includes a compound engagement profile 430 on its rotational leading edge 408 in order to improve rotational stability of down-hole equipment when rotationally engaging a wall of a borehole. It is also recognized that the compound engagement profile 430 may be provided on the rotationally opposite edge 409, which is suitable for a blade 401 that may be oriented in one of two directions when assembled with a stabilizer. As shown, the stabilizer blade 401 includes a bearing surface 406 and the compound engagement profile 430, where the stabilizer blade 401 may be used on expandable or fixed types of stabilizer assemblies. The compound engagement profile 430 in this embodiment of the invention is a compound arcuate bevel, which includes a first arcuate surface 432 and a second arcuate surface 434. The first arcuate surface 432 provides for a smooth, non-aggressive continuous transition surface (curvature illustrated by radius of curvature $R_1$) leading onto, relatively, bearing surface 406 of the stabilizer blade 401, while the second arcuate surface 434 provides transition between a leading face 440 and the first arcuate surface 432 or the bearing surface 406, or both, as the stabilizer blade 401 comes into contact with a formation. The second arcuate surface 434 has a steeper (i.e., smaller) radius of curvature $R_2$ relative to the first arcuate surface 432 to provide further transitional engagement onto the bearing surface 406 as the stabilizer blade 401 engages a formation. The first and second arcuate surfaces 432 and 434 extend continuously between the leading edge 408 and the bearing surface 406 of the stabilizer blade 401 and include smaller successive radiuses of curvature relative to the bearing surface 406, respectively. However, other suitable radii of curvature smaller in extent than the effective radius R of the bearing surface 406 may be employed. A tangential reference line $T_R$ is provided to illustrate the ideal engagement between the stabilizer blade 401 with the borehole wall $W_R$. The tangential reference line $T_R$ is perpendicular to the longitudinal axis L of the stabilizer blade 401 and substantially tangential to a portion of the bearing surface 406.

It is to be recognized that while the bearing surface 406 includes an arcuate shape having a radius of curvature R substantially configured to conform to an inner radius of a borehole (i.e., the so-called "gage OD" of a stabilizer), the bearing surface 406 may be flat or may include another shaped profile suitable for engaging the wall of a borehole.

Optionally, the transition between the second arcuate surface 434, the first arcuate surface 432 and the bearing surface 406 may be abrupt enough to be visually perceptible as illustrated by transition points 435 and 433, respectively, therebetween.

It is further recognized that a greater number of arcuate surfaces than the first and second arcuate surfaces 432 and 434 may be provided, respectively, where each additional arcuate surface includes a progressively smaller radius of curvature relative to any one of the preceding arcuate surfaces between it and the bearing surface 406.

As with the embodiment of the invention shown in FIG. 1, the stabilizer blades 201 of the expandable stabilizer 200 may be configured with a compound engagement profile in accordance with embodiments of the invention for improved engagement with obstructions on the wall of the borehole 12 caused by the formation 10, such as slump, swelled shale, or filter cake, or other anomalies reducing the size of, or causing irregularities (generally referenced by numeral 14) in the shape of the borehole 12 when the drilling assembly 20 rotates in the borehole 12. The expandable stabilizer 200 of the drilling assembly 20 may include a generally cylindrical tubular body 108 having the longitudinal axis L. The tubular body 108 may have a lower end and an upper end. The terms "lower" and "upper," as used herein with reference to the ends, refer to the typical positions of the lower and upper ends relative to one another when the drilling assembly 20 is positioned within a wellbore. The lower end of the tubular body 108 of the expandable reamer 100 may include a set of threads (e.g., a threaded male pin member) for connecting the lower end to another section of a drill string or another component of a bottom-hole assembly (BHA), such as, for example, a drill collar or collars carrying a pilot drill bit (not shown) for drilling a wellbore. Similarly, the upper end of the tubular body 108 of the expandable reamer 100 may include a set of threads (e.g., a threaded female box member) for connecting the upper end to another section of a drill string or another component of a bottom-hole assembly (BHA).

In other aspects of the invention, the fixed stabilizer blades or bearing pads 22 (as shown in FIG. 1) may also be configured with compound engagement profiles in accordance with embodiments of the invention to provide stabilizing support in the pilot borehole 12 for the expandable reamer 100, or other down-hole equipment, as the expandable reamer 100 enlarges the smaller borehole 12' diameter to that of expandable borehole 12 during down-hole drilling, while the expandable stabilizer 200 provides stabilizing support for the expandable reamer 100 in the expanded borehole 12, above the expandable reamer 100.

Typically, the expandable reamer 100 and the expandable stabilizer 200 may include a plurality of sliding cutter blocks or reamer blades 101 and a plurality of stabilizer blades or bearing pads 201, respectively, that are positionally retained in circumferentially spaced relationship in the tubular body 108 of the respective tool such as drilling assembly 20, as further described below and may be provided at a position between the lower end and the upper end. The blades 101 and 201 may be comprised of steel, tungsten carbide, a particle-matrix composite material (e.g., hard particles dispersed throughout a metal matrix material), or other suitable materials as known in the art. The blades 101 and 201 are retained in an initial, retracted position within the tubular body 108 of the expandable reamer 100 and the expandable stabilizer 200, but may be moved responsive to application of hydraulic pressure into the extended position (shown in FIG. 1) and moved back into a retracted position (not shown) when desired. The expandable reamer 100 and the expandable stabilizer 200 may be configured such that the blades 101 and 201, respectively, engage the walls of a subterranean formation surrounding a wellbore in which drilling assembly 20 is disposed to remove formation material when the blades 101 and 201 are in the extended position, but are not operable to so engage the walls of a subterranean formation within a wellbore when the blades 101 and 201 are in the retracted position. While the expandable reamer 100 may conventionally include three reamer blades 101, it is contemplated that one, two, or more than three blades may be utilized to improve performance in a given application. While the expandable stabilizer 200 may conventionally include three stabilizer blades 201 it is contemplated that one, two or more than three blades may be utilized to advantage. Moreover, in one embodiment, the expandable blades 101 and 201 are symmetrically circumferentially positioned axially along the tubular body 108, and in other embodiments, the expandable blades 101 and 201 may also be positioned circumferentially asymmetrically, as well as asymmetrically along the longitudinal axis L in the direction of either the lower or upper end.

The blades 101 and 201 of either of the expandable reamer 100 or the expandable stabilizer 200 may be operationally configured to extend or retract within the tubular body 108 as described in U.S. patent application Ser. No. 11/949,259, filed Dec. 3, 2007, now U.S. Pat. No. 7,900,717, issued Mar. 8, 2011, the disclosure of which is incorporated herein in its entirety by this reference. Optionally, any conventional expandable reamer or expandable stabilizer modified and reconfigured in accordance with the teachings of the invention herein may be utilized to advantage to provide an improved system or drilling assembly for stabilizing the drill string while reaming, drilling, or engaging the wellbore for other purposes. For example, any one or all of the blades of such conventional reamer or stabilizer may be replaced with a stabilizer blade 201, as shown in FIG. 1, configured in accordance with the invention herein presented. Specifically, the stabilizer blade 201 is configured to extend laterally and axially outward upon the application of hydraulic fluid pressure flowing through the drilling assembly 20 as provided for in the above-mentioned U.S. Pat. No. 7,900,717, however, it is also recognized that the stabilizer blade 201 (or the reamer blade 101) may be configured for lateral outward extension by other hydraulic fluid pressure or by any other mechanical means, such as a push rod, wedge or actuating motor or as conventionally understood to a person having ordinary skill in the stabilizer art.

The compound engagement profile in accordance with embodiments of the invention may be selectively used with the stabilizer and reamer described in U.S. patent application Ser. No. 12/058,384, filed Mar. 28, 2008, now U.S. Pat. No. 7,882,905, issued Feb. 8, 2011, and entitled "STABILIZER AND REAMER SYSTEM HAVING EXTENSIBLE BLADES AND BEARING PADS AND METHOD OF USING SAME," the disclosure of which is incorporated herein in its entirety by this reference.

Methods for stabilizing down-hole equipment in a subterranean borehole may include positioning in a borehole, with a drill string, a first tubular body carrying at least one stabilizer blade comprising a compound engagement profile configured for engaging a wall of the borehole; and rotating the drill string to provide stabilizing contact between the stabilizer blade and the wall of the borehole.

In accordance with embodiments of the invention the bevel surfaces of the compound engagement profile may have hardfacing applied thereupon in order to provide abrasion protection. Also, the hardfacing may be used to provide a configured radiused corner between bevel or arcuate surfaces, or transitioning onto a bearing surface of a stabilizer blade, in order to reduce the tendency of the stabilizer blade to grab a wall of a borehole upon rotation therewithin.

While particular embodiments of the invention have been shown and described, numerous variations and other embodiments will occur to those skilled in the art. Accordingly, it is intended that the invention only be limited in terms of the appended claims and their legal equivalents.

What is claimed is:

1. A blade for a stabilizer in a borehole in a subterranean formation, comprising:
   - a longitudinally extending body;
   - a bearing surface on the longitudinally extending body for laterally engaging a wall of the borehole during rotation of the stabilizer; and
   - a profile extending over a leading portion of the longitudinally extending body to the bearing surface and comprising a first curved surface rotationally preceding and extending from an intersection with the bearing surface and having a first radius of curvature and a second curved surface, curving in a same direction as the first curved surface, rotationally preceding and extending from an intersection with the first curved surface and having a second, different radius of curvature.

2. The blade for a stabilizer of claim 1, wherein the first radius of curvature is greater than the second, different radius of curvature.

3. A blade for use on a stabilizer when rotated in a borehole in a subterranean formation, comprising:
   - a longitudinally extending body;
   - a bearing surface on the longitudinally extending body for substantially laterally and rotationally engaging a wall of the borehole during rotation of the stabilizer; and
   - a compound engagement profile extending over a rotationally leading portion of the longitudinally extending body to the bearing surface and comprising a first planar bevel surface rotationally leading and extending from an intersection with the bearing surface at a first oblique bevel angle with respect to a tangential reference line at least substantially tangent to the bearing surface at a radially outermost point of the bearing surface, and a second planar bevel surface rotationally leading and extending from an intersection with the first planar bevel surface at a second, different oblique bevel angle with respect to the tangential reference line.

4. The blade for use on a stabilizer of claim 3, wherein the first oblique bevel angle is smaller than the second, different oblique bevel angle.

5. The blade for use on a stabilizer of claim 4, wherein the first oblique bevel angle is about 15° and the second, different oblique bevel angle is about 45°.

6. A stabilizer for a bottom-hole assembly for a borehole in a subterranean formation, comprising:

a body having a longitudinal axis extending therethrough;

a plurality of stabilizer blades carried by the body for laterally and rotationally engaging a wall of the borehole during rotation of the stabilizer, at least one stabilizer blade of the plurality comprising:

a stabilizer blade body;

a bearing surface; and a profile comprising at least two bevel surfaces extending over a leading portion of the body to the bearing surface configured for transitional engagement of the at least one stabilzer blade of the plurality with the wall of the borehole to ride on the bearing surface, wherein at least one bevel surface of the at least two bevel surfaces comprises a planar surface rotationally preceding and extending from an intersection with the bearing surface at a first oblique bevel angle with respect to a tangential reference line at least substantially tangent to the bearing surface at a radially outermost point of the bearing surface and at least a second bevel surface of the at least two bevel surfaces comprises a planar surface rotationally preceding and extending from an intersection with the at least one bevel surface at a second, different oblique bevel angle with respect to the tangential reference line.

7. The stabilizer of claim 6, wherein at the first oblique bevel angle is smaller than the second, different oblique bevel angle.

8. The stabilizer of claim 7, wherein the first oblique bevel angle is about 15° and the second, different oblique bevel angle is about 45°.

9. The stabilizer of claim 6, wherein the at least a second bevel surface of the at least two bevel surfaces includes a steeper transition relative to the at least one bevel surface of the at least two bevel surfaces.

10. The stabilizer of claim 6, wherein the at least one stabilizer blade of the plurality is an expandable stabilizer blade.

11. A method to stabilize components of a bottom-hole assembly in a subterranean borehole, comprising:

positioning a tubular body on a drill string in a borehole having a bottom-hole assembly in the drill string, the tubular body having a plurality of stabilizer blades, at least one stabilizer blade of the plurality comprising a profile comprising at least two bevel surfaces on a rotationally leading portion thereof and a bearing surface on a radially outermost portion thereof for engaging a wall of the borehole, a first bevel surface of the at least two bevel surfaces comprising a planar surface rotationally leading and extending from an intersection with the bearing surface at a first oblique bevel angle with respect to a tangential reference line at least substantially tangent to the bearing surface at a radially outermost point of the bearing surface and a second bevel surface of the at least two bevel surfaces rotationally leading and extending from an intersection with the first bevel surface at a second, different oblique bevel angle with respect to the tangential reference line;

rotating the drill string; and engaging the wall of the borehole with the at least two bevel surfaces of the profile of the at least one stabilizer blade of the plurality for stabilizing contact between the bearing surface of the at least one stabilizer blade of the plurality and the wall of the borehole.

12. A method for stabilizing down-hole components of a bottom-hole assembly in a subterranean borehole, comprising:

positioning in a borehole, with a drill string, a tubular body carrying a plurality of stabilizer blades, at least one stabilizer blade of the plurality comprising a compound engagement profile having at least two curved surfaces on a rotationally leading portion thereof and a laterally facing bearing surface on a radially outermost portion thereof configured for engaging a wall of the borehole, a first curved surface of the at least two curved surfaces rotationally leading and intersecting with the bearing surface and having a first radius of curvature and a second curved surface of the at least two curved surfaces, curving in the same direction as the first curved surface, rotationally leading and intersecting with the first curved surface and having a second, different radius of curvature; and rotating the drill string to engage the wall of the borehole with the compound engagement profile of the at least one stabilizer blade of the plurality with the at least two curved surfaces to facilitate stabilizing contact between the laterally facing bearing surface of the at least one stabilizer blade of the plurality and the wall of the borehole.

* * * * *